US006832582B2

(12) United States Patent
Rosskamp et al.

(10) Patent No.: US 6,832,582 B2
(45) Date of Patent: Dec. 21, 2004

(54) TWO-STROKE ENGINE AND METHOD OF MAKING THE SAME

(75) Inventors: Heiko Rosskamp, Adelberg (DE); Helmar Amend, Waiblingen (DE); Joachim Bretz, Prüm (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/457,438

(22) Filed: Jun. 10, 2003

(65) Prior Publication Data

US 2003/0226526 A1 Dec. 11, 2003

(30) Foreign Application Priority Data

Jun. 10, 2002 (DE) ..... 102 25 573

(51) Int. Cl.[7] ..... F02B 33/04
(52) U.S. Cl. ..... 123/73 PP
(58) Field of Search ..... 123/73 PP, 73 A, 123/73 R, 65 P, 65 R

(56) References Cited

U.S. PATENT DOCUMENTS 5,947,066 A * 9/1999 Ishikawa ..... 123/65 P

FOREIGN PATENT DOCUMENTS

| | | |
|---|---|---|
| FR | 2 825 761 | 12/2002 |
| GB | 1 474 464 | 5/1977 |
| JP | 55001430 | 1/1980 |
| JP | 2000170538 | 6/2000 |
| JP | 2002089357 | 3/2002 |

* cited by examiner

*Primary Examiner*—Tony M. Argenbright
*Assistant Examiner*—Hyder Ali
(74) *Attorney, Agent, or Firm*—Walter Ottesen

(57) ABSTRACT

A two-stroke engine having a combustion chamber (3) configured in a cylinder (2) is disclosed. The combustion chamber is delimited by a reciprocating piston (5). The two-stroke engine includes at least one transfer channel (10, 11) configured in the cylinder and fluidly connecting the combustion chamber and a crankcase (4). The transfer channel is delimited by a set wall (19) with respect to the interior space (18) of the cylinder at least over a portion of its longitudinal extent. The set wall may be held with respect to the interior space of the cylinder by a device configured with the cylinder as one part. A method for manufacturing the two-stroke engine provides that the cylinder is produced in the pressure-cast die process and a set wall is pushed into the cylinder between the cylinder interior space and the transfer channels and is thereafter fixed via a holding element.

15 Claims, 3 Drawing Sheets

Fig. 1
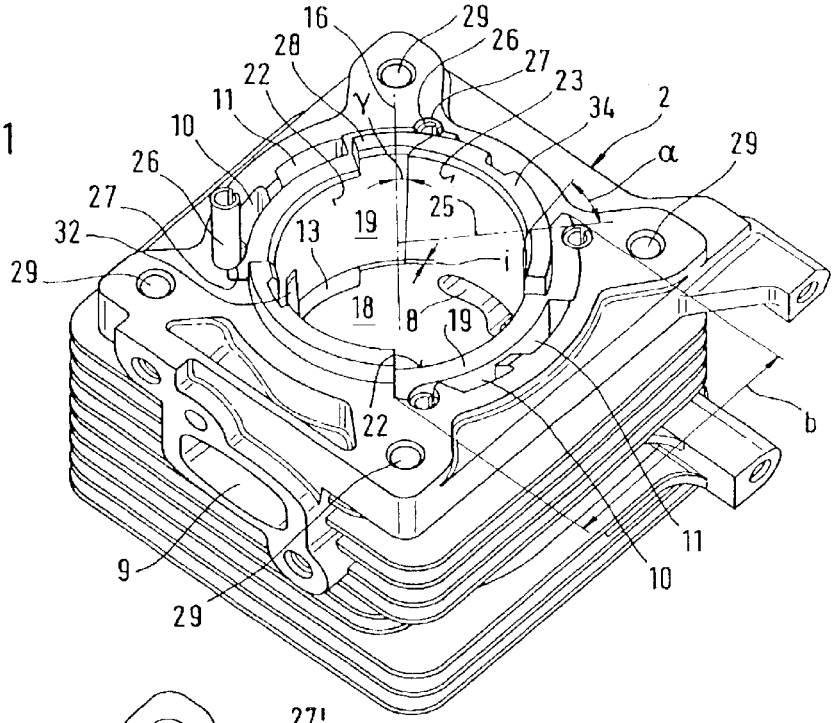
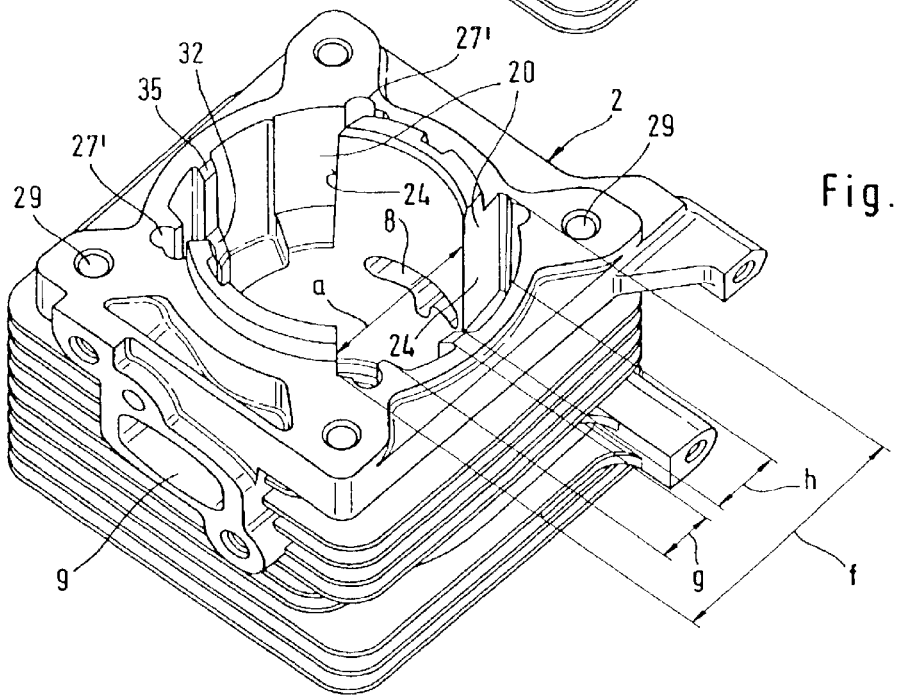
Fig. 2

TWO-STROKE ENGINE AND METHOD OF MAKING THE SAME

BACKGROUND OF THE INVENTION

Japanese patent publication 2000170538 discloses a two-stroke engine having outlet-near transfer channels which are delimited by set walls relative to the interior space of the cylinder. The set wall must be secured in its position. At the same time, existing tolerances must be compensated.

SUMMARY OF THE INVENTION

It is an object of the invention to provide a two-stroke engine which is advantageously manufactured and to also provide a method for making the two-stroke engine.

The two-stroke engine of the invention includes a two-stroke engine for a portable handheld work apparatus and the two-stroke engine includes: a crankcase; a cylinder connected to the crankcase; the cylinder having a cylinder wall defining an interior space; a piston displaceably mounted in the cylinder and the piston and the cylinder conjointly defining a combustion chamber; a crankshaft rotatably mounted in the crankcase; a connecting rod connecting the piston to the crankshaft so as to permit the piston to drive the crankshaft as the piston reciprocates in the cylinder between bottom dead center and top dead center; the cylinder having a discharge outlet formed therein for conducting exhaust gases away from the combustion chamber; an inlet leading into the crankcase; at least one transfer channel for fluidly connecting the crankcase to the combustion chamber at pregiven positions of the piston and the transfer channel opening into the cylinder via an inlet window; a set wall for delimiting the transfer channel with respect to the interior space of the cylinder over at least a portion of the longitudinal extent of the transfer channel; and, holding means for holding the set wall with respect to the interior space with the holding means being formed as one piece with the cylinder.

The number of individual parts to be assembled is reduced by securing the position of the set wall relative to the interior space of the cylinder by means which are configured as one piece with the cylinder. The means are produced with the cylinder in one method step. No additional holding means need be provided in the direction of the interior space of the cylinder. For this reason, the interior wall of the cylinder is unaffected by the holding means and therefore the piston running path is also unaffected thereby.

The set wall is held with respect to the cylinder interior space at at least one longitudinal end running approximately perpendicular to the peripheral direction of the cylinder. This is especially practical when the ends, which lie in the direction of the cylinder longitudinal axis, simultaneously define boundaries of the inlet window in the combustion chamber and the outlet window in the crankcase. Furthermore, this configuration makes possible the axial insertion of the set walls during assembly approximately in the direction of the longitudinal axis of the cylinder. The set wall is advantageously mounted in an assembly opening in the cylinder. The width of the assembly opening is measured perpendicularly to the longitudinal axis of the cylinder and is especially greater than the width of the transfer channel arranged in the region of the assembly opening. The set wall thereby projects beyond the transfer channel in the peripheral direction. In this way, a reliable sealing of the transfer channel to the interior space of the cylinder is ensured. At the same time, structural space for further means for fixing the set wall is provided, especially in the radial direction toward the outside.

The means for fixing the set wall in the direction toward the interior space of the cylinder are advantageously formed in that the distance of the longitudinal ends of the assembly opening is less on the end, which faces the interior space of the cylinder, than the width of the set wall at the same elevation. The width of the set wall is measured approximately in the peripheral direction and the longitudinal ends of the assembly opening run approximately in the direction of the longitudinal axis of the cylinder. With the above configuration, the set wall comes to rest in the region of its longitudinal ends behind the assembly opening viewed toward the interior space of the cylinder. To simplify assembly and to compensate for tolerances, it is provided that the set wall and the assembly opening are inclined relative to the longitudinal axis of the cylinder at their longitudinal ends. The opposite-lying longitudinal ends of the set wall and the opposite-lying longitudinal ends of the assembly opening run toward each other in the direction toward the combustion chamber.

To avoid affecting the running path of the piston, it is provided that the interior wall surface of the set wall, which faces the interior space of the cylinder, is offset relative to the cylinder interior wall radially toward the outside. A contact of the piston with the set wall is avoided in this manner. Advantageously, several, and especially two transfer channels, are delimited by a common set wall. In this way, the number of parts can be further reduced. At the same time, the assembly of this larger set wall is facilitated. Taken together, all set walls extend over 35% to 70% of the cylinder interior wall.

The set wall is fixed by a holding element to compensate for tolerances. The holding element especially fixes the set wall in the radial direction toward the outside. The holding element has spring-like or resilient characteristics at least in the radial direction to the longitudinal axis of the cylinder for compensating for tolerances. The holding element is arranged on the end of the set wall facing away from the interior space of the cylinder and is especially accommodated in a receptacle between the set wall and the cylinder. The holding element can press the set wall in this way in a direction toward the interior space of the cylinder against the means which hold the set wall in the direction toward the interior space of the cylinder. In this way, a reliable fixing of the set wall is ensured. The holding element is especially provided as a clamp pin. However, it can also be practical that the holding element be an adhesive. The holding element advantageously extends over a large portion of the length of the set wall. A simple manufacture and a reliable fixing can be achieved when the set wall is fixed by a weld or a solder. It can, however, also be advantageous that the set wall is pressed into the cylinder.

For the method of making a two-stroke engine with transfer channels open to the interior space of the cylinder, it is provided to manufacture the cylinder in the pressure die cast method. At least one set wall is pushed into the cylinder between the interior space of the cylinder and the transfer channel and the set wall is fixed after being pushed in by a holding element. The insertion of the set wall and the fixing thereof via a holding element makes possible a simple and cost effective manufacture. With the holding element, manufacturing tolerances can be compensated in a simple manner. At the same time, the set wall is reliably held in the cylinder.

The holding element is especially pushed in approximately parallel to the insert direction of the set wall and especially approximately in the direction of the longitudinal axis of the cylinder from the crankcase in the direction of the combustion chamber. The set wall is pushed into the cylinder after the cylinder is coated.

For a good fixing of position, the fixation of the set wall can be advantageously done with adhesive. It is also practical to fix the set wall with welding or soldering. In this way, additional attachment components are not necessary. Additional components are also avoided when the set wall is pressed in.

BRIEF DESCRIPTION OF THE DRAWINGS

The invention will now be described with reference to the drawings wherein:

FIG. 1 is a perspective view of a cylinder having set walls which have been pushed in;

FIG. 2 is a view of the cylinder of FIG. 1 without set walls;

DESCRIPTION OF THE PREFERRED EMBODIMENTS OF THE INVENTION

Figure 6:
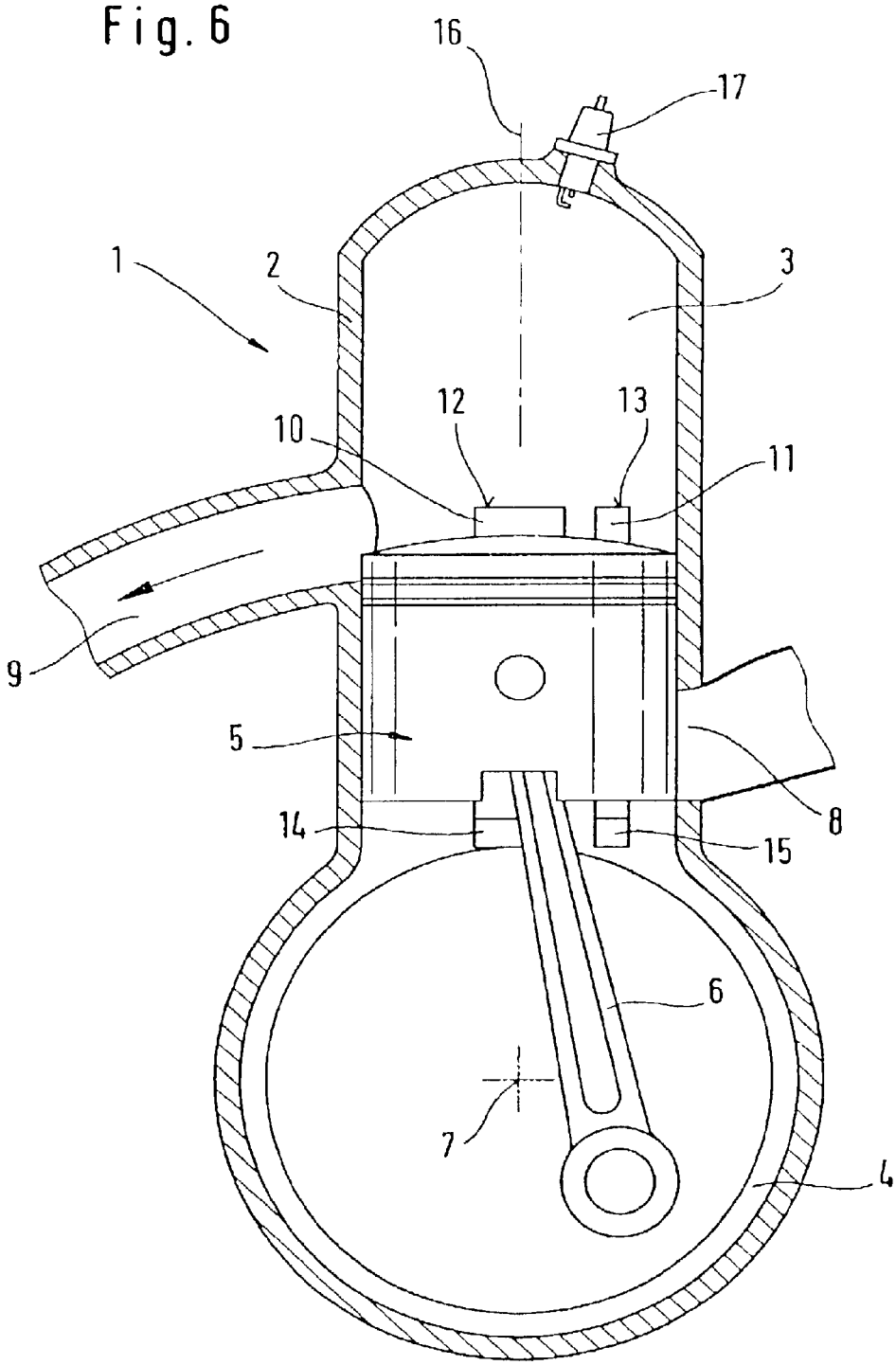
FIG. 6 is a schematic of a two-stroke engine.

In FIG. 6, a two-stroke engine 1 is shown schematically in longitudinal section. The two-stroke engine 1 includes a cylinder 2 having a combustion chamber 3 formed therein. The combustion chamber 3 is delimited by a piston 5 which moves upwardly and downwardly in the direction of the longitudinal axis 16 of the cylinder. The piston 5 drives a crankshaft 7 via a connecting rod 6. The crankshaft 7 is rotatably journalled in a crankcase 4. An air/fuel mixture, for example, from a mixture preparation device, reaches the crankcase 4 via the inlet 8. However, only combustion air can be guided into the crankcase 4 and the fuel is injected, for example, into the combustion chamber 3. An outlet 9 leads from the combustion chamber 3 for discharging exhaust gases. The crankcase 4 is fluidly connected to the combustion chamber 3 via transfer channels (10, 11) at specific positions of the piston 5. The outlet-near transfer channel 10 is connected to the crankcase 4 via an outlet window 14 and to the combustion chamber 3 via an inlet window 12. The outlet-remote transfer channel 11 has an outlet window 15 for connecting to the crankcase 4 and an inlet window 13 for connecting to the combustion chamber 3. Two outlet-near transfer channels 10 and two outlet-remote transfer channels 11 are respectively arranged symmetrically to a plane partitioning an outlet 9 and an inlet 8 approximately centrally.

An air/fuel mixture is supplied to the crankcase 4 via the inlet 8. The mixture in the crankcase 4 is compressed with the movement of the piston 5 in the direction toward the crankcase 4. As soon as the inlet windows (12, 13) open to the combustion chamber 3, the compressed air/fuel mixture flows through the transfer channels 10 and 11 into the combustion chamber 3. There, the air/fuel mixture is further compressed with the movement of the piston 5 in the direction toward top dead center and is ignited in the region of top dead center by a spark plug 17. As soon as the discharge opening 9 is cleared during the following downward movement of the piston 5, the exhaust gases are displaced from the combustion chamber 3 by the fresh air/fuel mixture after-flowing out of the transfer channels 10 and 11.

In FIG. 1, a cylinder 2 is shown in a perspective view with the viewing direction being toward the combustion chamber 3. In FIG. 2, the cylinder 2 is shown in a view corresponding to that of FIG. 1 but without set walls 19. The cylinder 2 includes an inlet 8 and an outlet 9 arranged approximately opposite to the inlet 8. As shown in FIG. 1, two outlet-near transfer channels 10 and two outlet-remote transfer channels 11 are arranged in the cylinder 2. The two outlet-near transfer channels 10 and the two outlet-remote transfer channels 11 lie approximately symmetrically to a plane partitioning inlet 8 and outlet 9 approximately centrally. The transfer channels (10, 11) are delimited toward the interior space 18 of the cylinder by two symmetrically arranged set walls 19. Each set wall 19 delimits two mutually adjacent transfer channels 10 and 11. The set walls 19 are each mounted in an assembly opening 20. In a direction toward the interior space 18 of the cylinder, the set walls 19 are held by means formed as one piece with the cylinder 2, namely, the longitudinal ends 24 of the assembly opening 20 which border on the set walls 19 and in which the set walls are mounted. The longitudinal ends 21 of the set walls 19 shown in FIG. 4 lie against the longitudinal ends 24 of the assembly openings 20. The longitudinal ends are the ends which run in the direction of the longitudinal axis 16 of the cylinder and lie approximately in the radial direction.

The longitudinal ends 24 of the assembly opening 20 as well as the longitudinal ends of the set wall 19 are inclined at an angle $\gamma$ relative to the longitudinal axis 16 of the cylinder. The two opposite-lying longitudinal ends 21 of the set wall 19 and the two opposite-lying longitudinal ends 24 of the assembly opening 20 run toward each other in a direction toward the combustion chamber 3. The set wall 19 therefore lies approximately wedge-shaped in the assembly opening 20 as shown in FIG. 2.

The inner wall surface 22 of the set wall 19 faces toward the interior space 18 of the cylinder and is at a radial spacing (i) relative to the cylinder wall surface 23. The wall surface 22 of the set wall 19 is offset radially toward the outside relative to the inner wall surface 23 of the cylinder. The radial spacing (i) can, for example, be 0.1 mm to 0.2 mm. On the side facing toward the inlet 8, the longitudinal ends 21 and 24 of set wall 19 and assembly opening 20 are inclined at an angle $\alpha$ relative to a radial 25 to the longitudinal axis 16 of the cylinder. The angle $\alpha$ of inclination is so selected that the longitudinal end 21 of the set wall 19 defines an obtuse angle with the inner wall surface 22 of the set wall 19.

The distance (a) of the longitudinal ends 24 of an assembly opening 20 shown in FIG. 2 at the side facing the interior space 18 of the cylinder is less than the width (b) of the set wall 19 shown in FIG. 1. The distance (a) and the width (b) are each measured approximately at the same elevation. The elevation here is the position in the direction of the longitudinal axis 16 of the cylinder. The width (b) of the set wall 19 is measured perpendicularly to the cylinder longitudinal axis 16 and approximately in the peripheral direction. The width (b) identifies the distance of the regions of the set wall 19 lying outside in radial direction. The width (b) corresponds approximately to the width (f) of the assembly opening 20 in the corresponding direction and each is measured at approximately the same elevation. The width (f) of the assembly opening is greater than the sum of the width (g) of the transfer channel 10 and the width (h) of the transfer channel 11 measured in the peripheral direction. However, it can be practical that a set wall 19 covers only one transfer channel. In this case, the affected assembly opening is wider than the assigned transfer channel.

All set walls, taken together, extend over 35% to 70% of the inner wall surface 23 of the cylinder. Accordingly, each set wall 19 extends over approximately 17% to 35% of the interior wall surface 23 of the cylinder with an arrangement of two symmetrically configured set walls 19 in the cylinder. A set wall 19, which covers only one transfer channel, can have a correspondingly smaller dimension in the peripheral direction.

The set walls 19 are fixed in the cylinder 2 by clamp pins 26. The clamp pins 26 project into receptacles 27 which are arranged between set wall 19 and the cylinder 2. The receptacles 27 are each configured in two parts. As shown in FIG. 2, each section 27' of the receptacle 27 is formed by the cylinder 2. On the end facing toward the inlet 8, the set walls 19 have rises 28 in the direction toward the crankcase 4 which end approximately even with a shoulder 34 formed on the cylinder 2. In the assembly of the cylinder 2 on a crankcase, the shoulder 34 serves to secure the position of the two parts. Crankcase and cylinder 2 are connected to each other via the attachment openings 29, especially, the crankcase and cylinder 2 are connected to each other with threaded fasteners.

Figure 4:
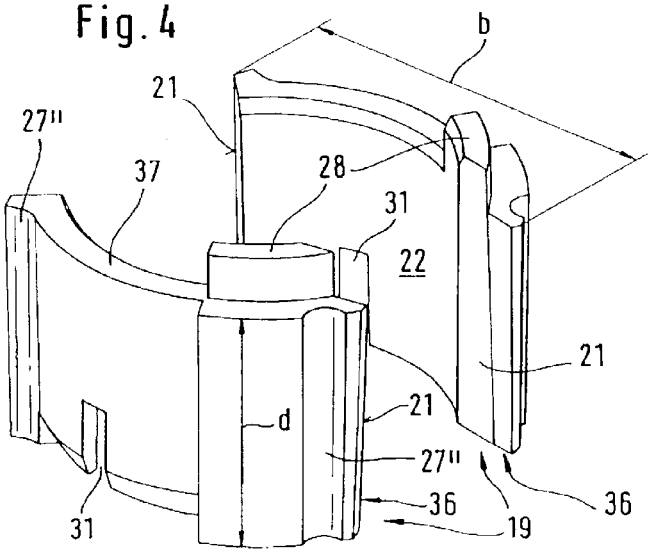
FIG. 4 is an enlarged perspective view of the set walls.

The transfer channels 10 and 11 are separated from each other in the peripheral direction by a partition wall 35 configured in the cylinder 2. On the end of the partition wall 35 facing toward the combustion chamber 3, a ridge 32 is provided which extends from the partition wall 35 in a direction toward the interior space 18 of the cylinder. Correspondingly, the set walls 19 each have a slot 31 as shown in FIG. 4 which engages the ridge 32. The slot 31 engages around the ridge 32 and, in this way, the set walls 19 are secured in position.

Figure 3:
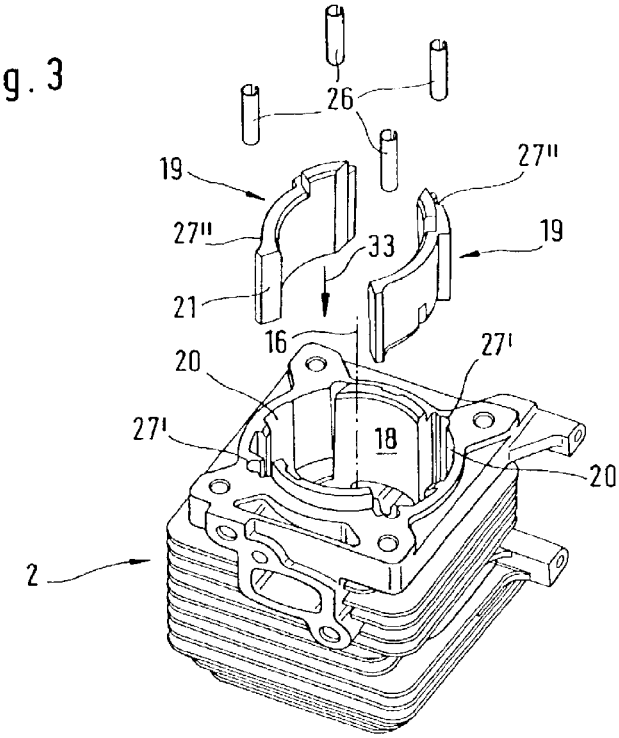
FIG. 3 is an exploded view of a cylinder having set walls and clamp pins.

FIG. 3 is an exploded view showing the cylinder 2 with two symmetrically configured set walls 19 as well as four clamp pins 26. For assembly, the cylinder 2 is first produced in a pressure-die casting process. The set walls 19 are pushed into the assembly openings 20 in the cylinder 2 in the direction of arrow 33. Thereafter, the set walls are fixed with clamp pins 26. The clamp pins 26 are likewise pushed in parallel to the longitudinal axis 16 of the cylinder in the direction of arrow 33. The clamp pins 26 come to rest in the receptacles 27. Each receptacle 27 is formed by a section 27', which is configured in the cylinder 2, and a section 27" which is configured on the set wall 19. Each set wall 19 is then fixed by two clamp pins 26. The clamp pins 26 come to rest between the cylinder and the set wall 19 and press the set walls 19 in a direction toward the interior space 18 of the cylinder. The longitudinal ends 24 of the assembly opening 20 and the set wall 19 are inclined at an angle $\alpha$ and are fixed in this way.

Figure 5:
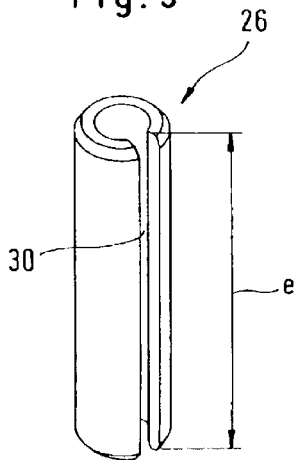
FIG. 5 is an enlarged perspective view of a clamp pin.

FIG. 4 is an enlarged perspective view showing two symmetrically configured set walls 19. On the end 36 facing toward the inlet 8, the rise 28 is arranged on the end 37 facing toward the crankcase 4. The rise 28 extends over approximately half of the radial dimension of the set wall 19 in this region. The set wall 19 has the length (d) radially outside of the rise 28. The clamp pin 26, which is shown in FIG. 5, has a length (e) which corresponds approximately to the length (d) of the set wall. In each case, the length is the extent in the direction of the longitudinal axis 16 of the cylinder. The clamp pin 26 extends approximately over the entire length (d) of the set wall 19. The clamp pin 26 has a longitudinal slot 30. The clamp pin is configured to be cylindrical and hollow so that it has resilient or spring characteristics because of the slit 30. In the built-in state, the clamp pin 26 presses in radial direction toward the longitudinal axis 16 of the cylinder and therefore against the set walls 19.

It can be practical to use adhesive in lieu of the clamp pins as a holding element. Also, radial tolerances can be compensated with the use of adhesive. Furthermore, additionally or alternatively, a seal can be provided between the set wall 19 and the cylinder 2 to compensate for tolerances. To secure the position, the set walls can also be pressed in. Also, metallic connections such as welding or soldering can be practical. The set wall 19 can, for example, be made of aluminum. However, the set wall can also be made of other materials such as plastic. In lieu of the end wall for fixing the set walls 19 in the direction of the cylinder interior space 18, it can also be practical to provide a slot in which the set wall or a guide element on the set wall is guided. The slot runs approximately parallel to the longitudinal axis 16 of the cylinder and the end wall for fixing the set wall 19 runs approximately in the radial direction and is inclined relative to this radial direction.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine for a portable handheld work apparatus, the two-stroke engine comprising:

a crankcase;

a cylinder connected to said crankcase;

said cylinder having a cylinder wall defining an interior space;

a piston displaceably mounted in said cylinder and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an inlet leading into said crankcase;

at least two transfer channel for fluidly connecting said crankcase to said combustion chamber at pregiven positions of said piston and said transfer channel opening into said cylinder via an inlet window;

a set wall, common to said at least two transfer channels, for delimiting said at least two transfer channels with respect to said interior space of said cylinder over at least a portion of the longitudinal extent of said transfer channels; and, holding means for holding said set wall with respect to said interior space with said holding means being formed as one piece with said cylinder.

2. The two-stroke engine of claim 1, further comprising:

an additional set wall, and additional transfer channels fluidly connecting said crankcase to said combustion chamber at pregiven positions of said piston.

3. The two stroke engine of claim 2, wherein said set walls taken together extend over 35 to 70% of the inner wall of said cylinder.

4. The two-stroke engine of claim 1, wherein said set wall is fixed by welding or soldering.

5. The two-stroke engine of claim 1, wherein said set wall is pressed into said cylinder.

6. A two-stroke engine including a two-stroke engine for a portable handheld work apparatus, the two-stroke engine comprising:

a crankcase;

a cylinder connected to said crankcase;

said cylinder having a cylinder wall defining an interior space;

a piston displaceably mounted in said cylinder and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an inlet leading into said crankcase;

at least one transfer channel for fluidly connecting said crankcase to said combustion chamber at pregiven positions of said piston and said transfer channel opening into said cylinder via an inlet window;

a set wall for delimiting said transfer channel with respect to said interior space of said cylinder over at least a portion of the longitudinal extent of said transfer channel; and, holding means for holding said set wall with respect to said interior space with said holding means being formed as one piece with said cylinder, wherein:

said cylinder defines a longitudinal axis;

said holding means includes an assembly opening forward in said cylinder;

said set wall is mounted in said assembly opening and said set wall has at least one longitudinal end at which said set wall is held relative to said interior space of said cylinder;

said assembly opening has a width (f) measured perpendicular to said longitudinal axis;

said transfer channel is disposed in the region of said assembly opening and has a width (g, h); and, said width (f) of said assembly opening is greater than said width (g, h) of said transfer channel.

7. The two-stroke engine of claim 6, wherein:

said assembly opening has opposite-lying longitudinal ends formed in said cylinder to run in the direction of said longitudinal axis; said longitudinal ends are at distance (a) from each other on a side thereof facing toward said interior of said cylinder;

said set wall has a width (b) measured approximately in the peripheral direction;

said distance (a) is less than said width (b) of said set wall with said distance (a) and said width (b) being measured at approximately the same elevation; and, said set wall and said assembly opening are inclined at an angle (γ) relative to said longitudinal axis at corresponding ones of said longitudinal ends thereof;

the longitudinal ends of each of said set wall and said assembly opening run toward each other in a direction toward said combustion chamber; and, said cylinder wall has an inner wall surface and said set wall has an inner wall surface offset radially outwardly relative to said inner wall surface of said cylinder wall.

8. The two-stroke engine of claim 6, wherein said set wall is fixed by welding or soldering.

9. The two-stroke engine of claim 6, wherein said set wall is pressed into said cylinder.

10. A two-stroke engine including a two-stroke engine for a portable handheld work apparatus, the two-stroke engine comprising:

a crankcase;

a cylinder connected to said crankcase;

said cylinder having a cylinder wall defining an interior space;

a piston displaceably mounted in said cylinder and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an inlet leading into said crankcase;

at least one transfer channel for fluidly connecting said crankcase to said combustion chamber at pregiven positions of said piston and said transfer channel opening into said cylinder via an inlet window;

a set wall for delimiting said transfer channel with respect to said interior space of said cylinder over at least a portion of the longitudinal extent of said transfer channel;

holding means for holding said set wall with respect to said interior space with said holding means being formed as one piece with said cylinder;

at least one holding element for fixing said set wall in radial direction toward the outside;

said holding element being arranged on the side of said set wall facing away from said interior of said cylinder; and, a receptacle being formed between said set wall and said cylinder for said holding element.

11. The two-stroke engine of claim 10, said holding element having a spring characteristic to a direction radial to said longitudinal axis and said holding element being mounted in said receptacle so as to extend over most of the length (d) of said set wall in the direction of said longitudinal axis.

12. A method of making a two-stroke engine, the method comprising the steps of:

utilizing a pressure die casting process to make the cylinder of said engine with a transfer channel open to the interior space of said cylinder;

inserting at least one set wall between said interior and said transfer channel; and, fixing said set wall by inserting a holding element.

13. The method of claim 12, wherein said engine includes a combustion chamber formed in said cylinder with said combustion chamber being delimited toward a crankcase by a piston and said cylinder defining a cylinder longitudinal axis; said holding element is pushed in approximately parallel to the insert direction of said set wall between said set wall and said cylinder; and, said set wall is pushed in approximately in the direction of said cylinder longitudinal axis from said crankcase in a direction toward said combustion chamber.

14. The method of claim 12, wherein said set wall is fixed utilizing adhesive as a holding element.

15. A method of making a two-stroke engine, the method comprising the steps of:

utilizing a pressure die casting process to make the cylinder of said engine with a transfer channel open to the interior space of aid cylinder;

inserting at least one set wall between said interior and said transfer channel; and, fixing said set wall by welding or soldering.

* * * * *